United States Patent [19]

Korthaus

[11] Patent Number: 4,768,420

[45] Date of Patent: Sep. 6, 1988

[54] CONTROL ARRANGEMENT FOR CONTROLLING A HYDRAULIC DRIVE FOR DRIVING A PISTON PUMP

[76] Inventor: Ernst Korthaus, Landwehr 25, 5982 Neuenrade, Fed. Rep. of Germany

[21] Appl. No.: 34,853

[22] Filed: Apr. 3, 1987

[30] Foreign Application Priority Data

Apr. 4, 1986 [DE] Fed. Rep. of Germany ..... 3611212

[51] Int. Cl.[4] ..... F15B 13/43

[52] U.S. Cl. ..... 91/444; 91/417 R; 417/390

[58] Field of Search ..... 91/444–448, 91/417 R; 417/390

[56] References Cited

U.S. PATENT DOCUMENTS

| | | | |
|---|---|---|---|
| 3,882,896 | 5/1975 | Budzick | 91/446 |
| 3,908,515 | 9/1975 | Johnson | 91/445 |
| 3,943,715 | 3/1976 | Miyao et al. | 91/417 R |
| 4,066,006 | 1/1978 | Heiser | 91/445 |
| 4,136,600 | 1/1979 | Heiser | 91/445 |
| 4,282,898 | 8/1981 | Harmon et al. | 91/446 |
| 4,401,009 | 8/1983 | Zeuner et al. | 91/446 |
| 4,418,612 | 12/1983 | Nanda | 91/445 |
| 4,569,272 | 2/1986 | Taylor et al. | 91/445 |

FOREIGN PATENT DOCUMENTS

| | | | |
|---|---|---|---|
| 1042504 | 1/1953 | Fed. Rep. of Germany | 91/417 R |
| 607061 | 5/1978 | U.S.S.R. | 91/417 R |
| 739260 | 6/1980 | U.S.S.R. | 91/417 R |
| 840518 | 6/1981 | U.S.S.R. | 91/444 |
| 916787 | 3/1982 | U.S.S.R. | 91/417 R |

*Primary Examiner*—Edward K. Look
*Assistant Examiner*—John T. Kwon
*Attorney, Agent, or Firm*—Walter Ottesen

[57] ABSTRACT

A control arrangement for hydraulic drives for driving piston pumps includes a control piston which is switchable between its end positions. The control piston has reciprocably effective longitudinally-extending flow restrictors connected into the power lines of the hydraulic drive and the control valves corresponding to each flow restrictor are provided with a pressure balancer. The direction of flow of the hydraulic fluid is the same through all flow restrictors in all switching positions of the control piston. The pressure balancer is controlled by the drop in pressure across the flow restrictor corresponding thereto. The outlet of the control valve for the hydraulic fluid flowing to the hydraulic drive and the inlet for the hydraulic fluid flowing away from the hydraulic drive are connected together at a common connecting terminal of the hydraulic drive.

11 Claims, 3 Drawing Sheets

CONTROL ARRANGEMENT FOR CONTROLLING A HYDRAULIC DRIVE FOR DRIVING A PISTON PUMP

FIELD OF THE INVENTION

The invention relates to a control arrangement for a hydraulic drive for driving a piston pump. The control arrangement includes a control unit having a control piston switchable between two end positions and having reciprocably effective longitudinal flow restrictors arranged in the power lines of the hydraulic drive.

BACKGROUND OF THE INVENTION

A piston pump for which a control arrangement of the kind referred to above is suitable is disclosed, for example, in German published patent application DE-OS No. 34 10 911. Such piston pumps are utilized typically as contractor's pumps for withdrawing dirty water from excavations and the like. This entails especially the pumping of gas-free liquids. When the ground water table drops, a negative pressure can occur in the intake pipe of such contractor's pumps, such negative pressure acting as a pulling load on the pump piston after the latter has reversed the direction of its travel. Moreover, a breakdown of the liquid column in the suction chamber of the pump can result in cavitation. Such compressive loads on the pump piston can lead to undesirable accelerations of the piston after the latter has reversed the friction of its travel, thus causing damage to seals as a result of the frictional heat caused by the acceleration. Contractor's pumps must be self-priming, that is to say they must initially be able to pump air. Next, the pump must also be able to pump mixtures of air and water, with the air contained in the water constituting a compressible substance which, having been compressed by the pump, in turn constitutes an additional load acting upon the pump's piston rod.

SUMMARY OF THE INVENTION

It is an object of the invention to provide a control arrangement for the hydraulic drive for a piston pump which provides a precisely determined movement pattern under all of the above-mentioned loading situations.

The control arrangement according to the invention is for a hydraulic drive for driving a piston pump. The hydraulic drive includes a hydraulic cylinder and a hydraulic piston connected to the piston pump being driven with the hydraulic cylinder and hydraulic piston conjointly defining a cylinder chamber and a piston-rod chamber. The control arrangement of the invention includes: reservoir means for holding hydraulic fluid; hydraulic fluid supply means for supplying hydraulic fluid under pressure; a first hydraulic power line for conducting hydraulic fluid toward the hydraulic drive from the hydraulic fluid supply means; a second hydraulic power line for conducting hydraulic fluid away from the hydraulic drive toward the reservoir means; a control unit including a housing and a control piston movably mounted in the housing between a first end position and second end position, the control piston including reciprocably acting first and second flow restrictors which restrict the flow of hydraulic fluid through the control piston in dependence upon the location of the control piston between the end positions; the control unit being connected into the hydraulic power lines so as to cause the direction of flow through the first flow restrictor to always be toward the hydraulic drive and the direction of flow through the second flow restrictor to always be away from the hydraulic drive irrespective of the location of the piston between the end positions; the control unit further including: first control valve means communicating with the first flow restrictor for passing hydraulic fluid to the hydraulic drive and second control valve means communicating with the second flow restrictor for passing hydraulic fluid away from the hydraulic drive; ancillary hydraulic circuit means for connecting the first control valve means and the second control valve means to one of the chambers of the hydraulic drive; and, first and second pressure balancers operatively connected to respective ones of the first and second restrictors so as to be actuable in response to a drop in pressure across the flow restrictor corresponding thereto.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
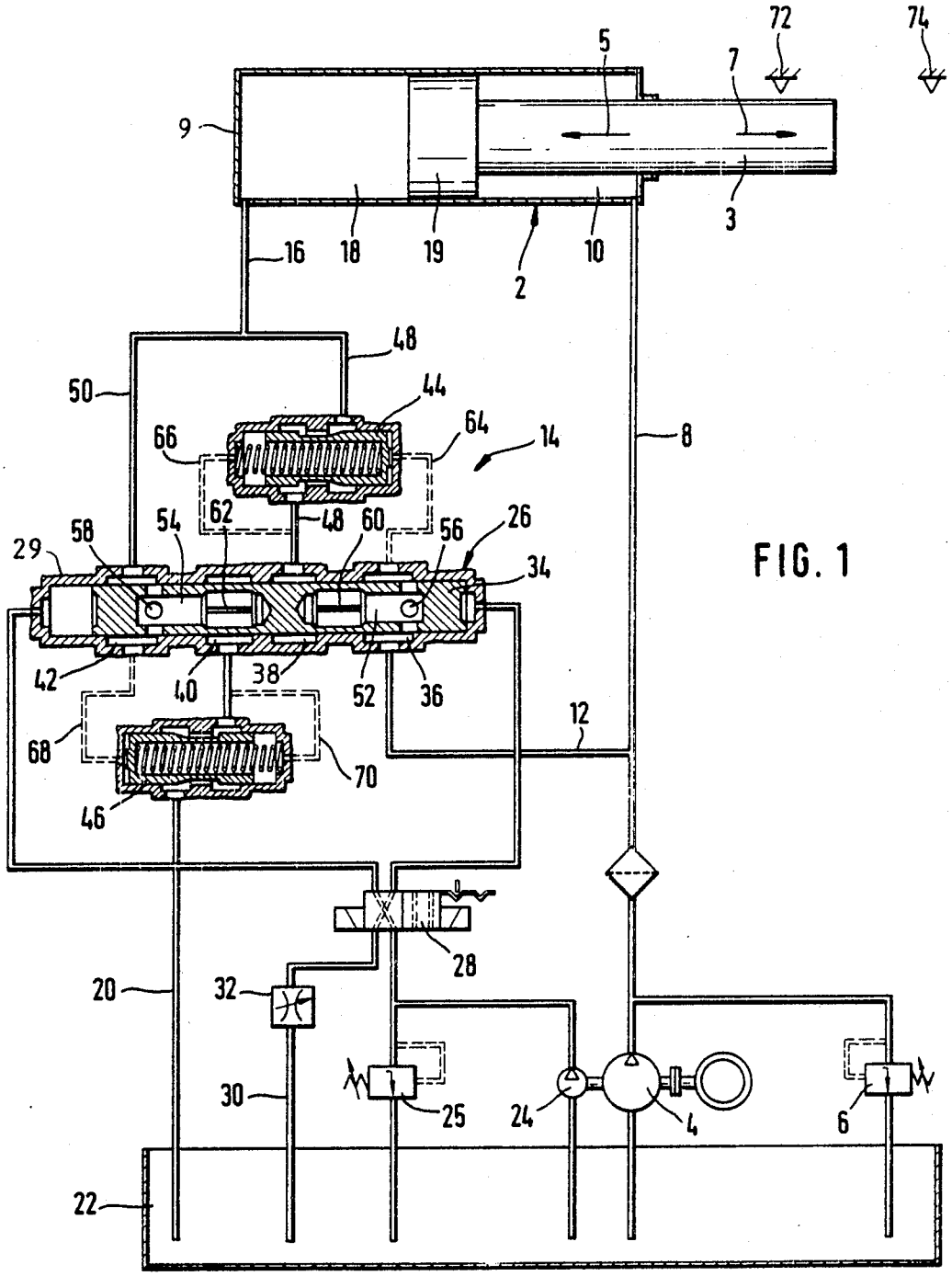
FIG. 1 is a schematic of a hydraulic pump drive having a different cylinder and equipped with the control arrangement according to an embodiment of the invention.

The schematic of FIG. 1 includes a differential hydraulic drive 2 which serves as a thrust-piston drive. The hydraulic drive includes a hydraulic cylinder 9 in which a hydraulic piston 19 is mounted for reciprocating movement. Hydraulic fluid acts on both sides of the piston 19. A piston pump (not shown) is connected to the piston rod 3 of the hydraulic drive 2. The pressure-oil supply is supplied by the hydraulic pump 4 at a constant discharge. The pump 4 is protected at the pressure side by a pressure-limiting valve 6 in a conventional manner. The pressure line 8 of the hydraulic pump 4 leads to the piston-rod chamber 10 of the hydraulic drive 2. A branch line 12 leads away from the pressure line 8 and passes via control unit 14 to connecting line 16 of the piston chamber 18 of the hydraulic drive 2. A tank line 20 leads to the oil tank 22 from the control unit 14 which will be described below.

An auxiliary pump 24 is directly coupled to the hydraulic pump 4 and is protected by means of a pressure-limiting valve 25. The auxiliary pump 24 delivers pressure oil for switching the control valve 26 which is switchable via a remotely-controlled electromagnetic reversing valve 28. An adjustable flow restrictor 32 is connected into the tank line 30 of this hydraulic circuit. The flow restrictor 32 is utilized to adjust the speed of the movement of the control piston 34 of the control valve 26 when the latter is switched. The housing 29 of the control valve 26 is shown in FIG. 1 by a hatched outline. Four annular chambers 36, 38, 40 and 42 are formed in this housing 29 of which the right-hand chamber 36 is connected to the branch line 12.

In addition to the control valve 26, the control unit 14 includes two pressure balancers (44, 46). The pressure balancer 44 is connected into a line 48 which leads away from the annular chamber 38 of the control valve 26 and leads to connecting line 16 of the hydraulic drive 2. The annular chamber 42 is also connected to line 16 via a line 50. The tank line 20 is connected to the annular chamber 40 via the pressure balancer 46.

The control piston 34 is configured as a hollow piston with two hollow chambers (52, 54) which are provided with supply bores (56, 58) in the region of annular chambers 36 and 42, respectively. The two chambers (52, 54) are provided with flow-restricting slits (60, 62) at the respective ends thereof facing toward each other. The flow-restricting slits (60, 62) are arranged in the region of the annular chambers (38, 40), respectively. The flow-restricting slits 60, 62 are configured as slits through which the hydraulic fluid flows radially.

Pressure balancer 44 is connected with its control lines 64, 66 in parallel to flow-restricting slit 60 with the control lines 64 and 66 being connected to annular chambers 36 and 38, respectively. On the other hand, the pressure balancer 46 is connected with its control lines 68, 70 in parallel to the flow-restricting slit 62 with the control lines 68, 70 connected to annular chambers 42 and 40, respectively. In this connection, attention is called to the fact that the control lines are shown in the drawing with broken or dashed lines.

Both surfaces of piston 19 are charged with hydraulic oil and the ratio of these two surfaces to each other is 2:1. Surface ratios departing from this ratio can also be selected.

In the position shown, the control piston 34 of the control valve 26 is in its right-hand end position and the piston 19 is at its mid position. In this position of the control piston 34, the connection between the annular chambers 36 and 38 is blocked. The pump 4 therefore pumps only into the piston-rod chamber 10 of the hydraulic drive 2. From the piston end 18 of the hydraulic drive 2, hydraulic fluid flows through the lines 16 and 50 and then through the flow-restricting slit 62 and from there through the pressure balancer 46 and then through line 20 into tank 22. The piston 19 then moves toward the left in the direction of arrow 5.

If a pulling load in the direction of arrow 5 acts on piston 19 in addition to the normal load when the piston 19 is at an intermediate position, the oil flowing out of cylinder chamber 18 and through line 16 is increased. This increased flow of hydraulic fluid immediately leads to an increase in pressure when flowing through flow-restricting slit 62. This increase in pressure closes the pressure balancer 46 via the control line 68 and therefore prevents an increased flow of hydraulic fluid from the cylinder chamber 18. In this way, an increased pulling load is effectively countered and a uniform movement of the piston 19 is assured. As mentioned earlier, such a pulling load can result, for example, from an underpressure in the intake pipe of the pump (not shown) to which the piston rod 3 is connected.

Stationary sensors (72, 74) are provided in the region of movement of the piston rod 3. The sensors 72, 74 are schematically represented in FIG. 1 and can be in the form of proximity switches, trip switches or the like. The sensors can be configured so that they respond, for example, to definite markings on the piston rod which are sensed. These markings are so arranged that the sensors 72 and 74 respond at predetermined spacings of the piston 19 from its left-hand and right-hand end positions, respectively. The deceleration of the piston is initiated after one of such sensors responds.

This deceleration is caused by the reversal of the reversing valve 28 at which time the hydraulic pressure oil flows into the actuating chamber ahead of the right-hand end face of the control piston 34 while hydraulic pressure oil flows out from the left-hand actuating space via throttle 32 into the tank 22. The control piston 34 is displaced toward the left with a velocity dependent upon the adjusted pass-through opening of the throttle 32. During this displacement movement, the through-flow cross section of the longitudinally-extending flow restrictor 62 is reduced in an amount that the through-flow cross section of longitudinally-extending flow restrictor 60 is increased. In this way, the hydraulic fluid moves from the line 12 through the pressure balancer 44 into the line 50 and from there through the flow restrictor 62 and the pressure balancer 46 into tank line 20. The amount pumped via line 8 into piston-rod chamber 10 is reduced by the amount which flows into the tank 22. At the same time, the flow out of the cylinder chamber 18 is reduced by the amount of hydraulic fluid which flows through the flow-restricting slit 60 since the total runoff is determined by the through-flow cross section of flow-restricting slit 62 and this cross section has become smaller by the leftward movement of the control piston 34. The hydraulic fluid flow through the flow restrictor 60 and the pressure balancer 44 as well as the flow restrictor 62 and through the pressure balancer 46 are dependent upon the position of the control piston 34 and continuously change during the displacement movement of this piston. By adjusting the displacement velocity of the control piston 34 via the throttle 32, a deceleration and acceleration ramp can be determined; that is, the deceleration with time when approaching the end positions and the acceleration with time after the direction of movement of the piston 19 is reversed.

When the control piston 34 has reached its midposition and therefore the inflow via flow restrictor 60 is the same as the outflow via flow restrictor 62, the piston 19 comes to a standstill at the leftward end of its stroke. With a further movement of the control piston 34 in the direction toward the left-hand end position, more hydraulic fluid passes through the flow restrictor 60 than flows out through flow restrictor 62. Therefore, a reversal in the movement of the piston 19 occurs with an acceleration which follows a ramp which corresponds to the deceleration ramp occurring when nearing the end position of the stroke. The hydraulic fluid forced out of the piston-rod chamber 10 in this direction of movement is conducted in addition into the cylinder chamber 18. A pulling load in this direction of the piston 19 corresponding to the arrow 7 and can lead to no acceleration of the runout movement since the hydraulic fluid displaced from the piston-rod chamber 10 is held constant independent of load via the flow restrictor 60 in combination with the pressure balancer 44.

With the control arrangement described, the piston 19 can be made to carry out a predetermined program of movement independent of load. By means of the flow restrictors operatively connected to respective ones of the pressure balancers, the required hydraulic restraint of the piston is achieved for this purpose.

Figure 2:
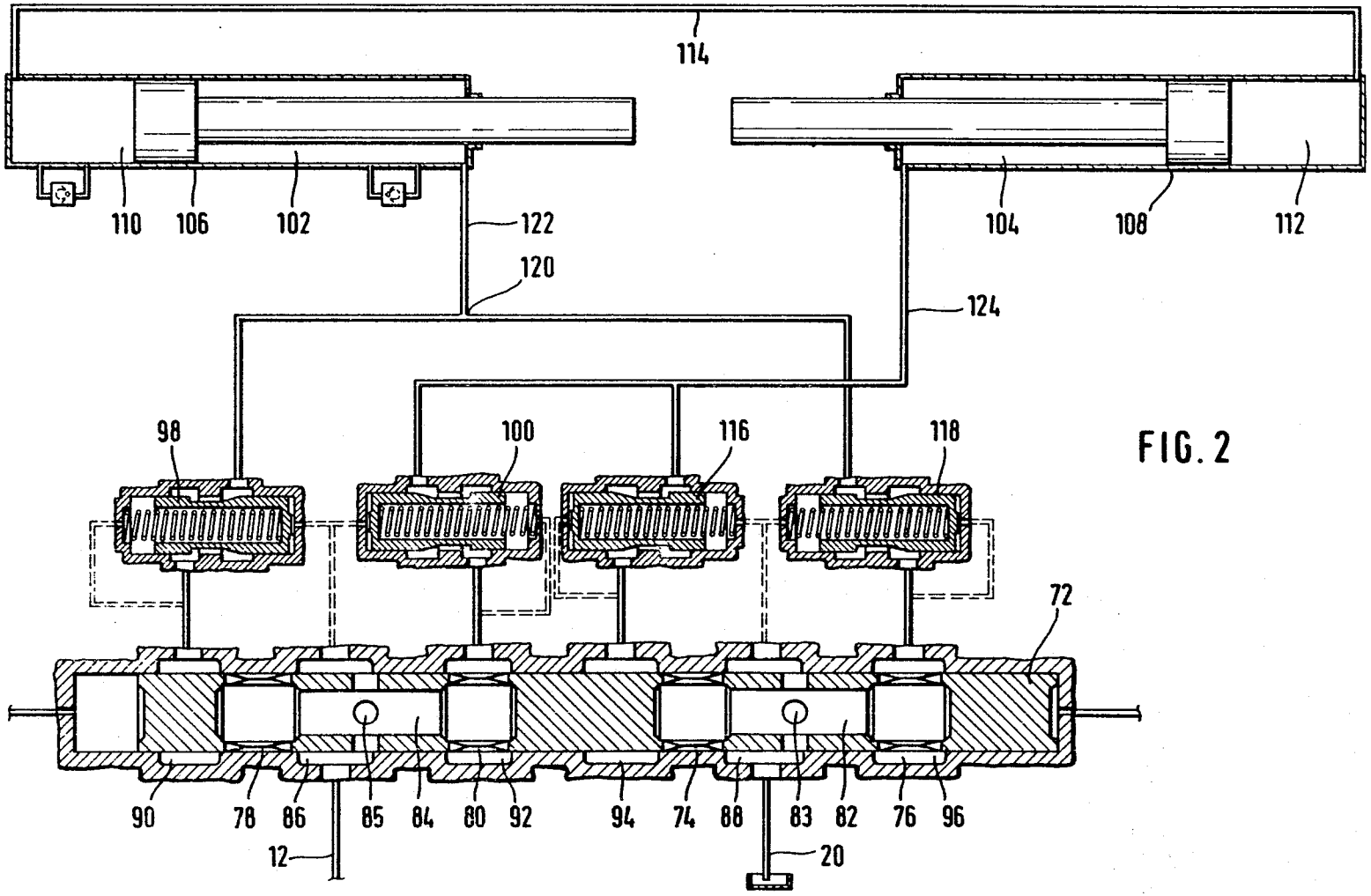
FIG. 2 is a further embodiment of the control arrangement of the invention adapted to two hydraulic drives in tandem; and, FIG. 3 is a schematic of the same control arrangement of FIG. 2 in combination with an individual differential cylinder.

For the embodiment of FIG. 2, only the control valve with its control piston and the pressure balancers corresponding thereto as well as two hydraulic drives working in tandem are illustrated. In the control piston 72, two pairs of longitudinal throttles (74, 76 and 78, 80) are shown and are arranged in spaced relationship to each other along the longitudinal axis of the piston 72. The first pair of throttles 74, 76 are provided with a hollow space 82 and are connected thereby to a connecting bore 83 which is radially mounted in the center of this hollow space 82. In the same way, the second pair of throttles 78, 80 are connected via the hollow space 84 with a connecting bore 85 arranged at the mid location of the latter. The left-hand throttle pair 78, 80 is connected to the inflow line 12 via the connecting bore 85 while the throttle pair 74, 76 is connected with the tank line 20 via connecting bore 83. The connections 12 and 20 communicate with annular chambers 86, 88 while the throttles 74, 76 and throttles 78, 80 coact with annular chambers 90, 92 and annular chambers 94, 96, respectively. The annular chamber 90 is connected via pressure balancer 98 with the piston-rod chamber 102 of the hydraulic drive 106. On the other hand, annular chamber 92 is connected with the piston-rod chamber 104 of hydraulic drive 108 via pressure balancer 100. The two cylinder chambers 110, 112 of the hydraulic drives are connected with each other via line 114 in the manner of a hydraulic linkage. The control lines of the pressure balancers 98 and 100 are illustrated by broken lines and are switched via the throttles 78 and 80, respectively.

Two further pressure balancers 116 and 118 are provided. Pressure balancer 116 is connected ahead of the annular chamber 94 and therefore is in the flow direction of throttle 74 of the further throttle pair. On the other hand, pressure balancer 118 is connected ahead of annular chamber 96 and therefore in the flow direction of throttle 76 also of the further throttle pair. The inlet of the pressure balancer 118 is connected at location 120 with the inflow line 122 of the piston chamber 102 of the hydraulic drive 106; while, the inlet of the pressure balancer 116 is connected with the line 124 leading to the piston-rod chamber 104 of the hydraulic drive 108. The function of this embodiment of the control unit is clear from the description above with respect to FIG. 1. Also with this arrangement having two hydraulic drives, a controlled hold of the piston during all operating conditions is assured by means of the combination of the throttles and the pressure balancers corresponding thereto.

Figure 3:
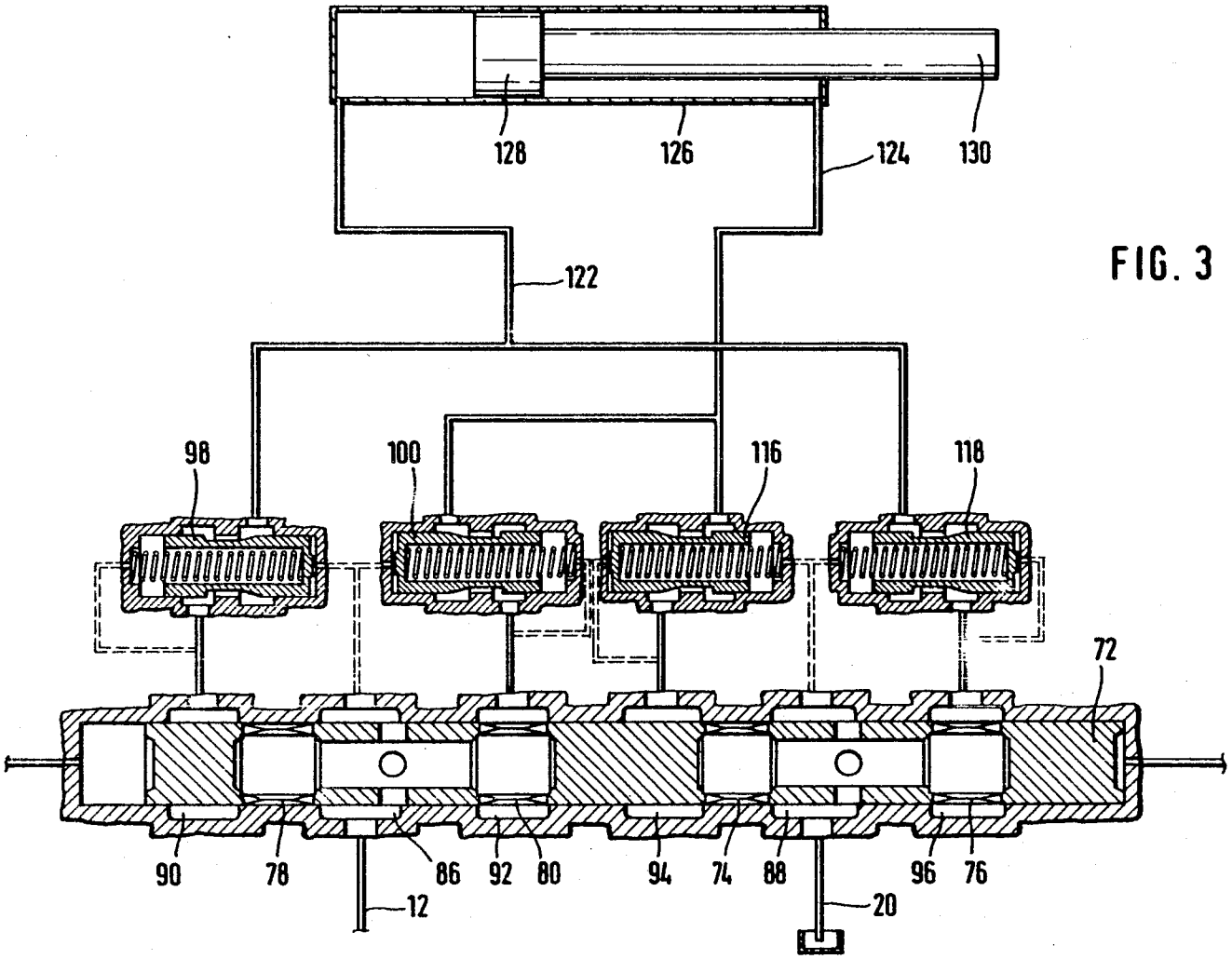

The circuit arrangement of FIG. 3 corresponds to the control arrangement of FIG. 2 and to this extent attention is directed to the description with respect to FIG. 2. Accordingly, the same reference numerals are used in FIG. 3 as were used in FIG. 2. A departure in FIG. 3 from the embodiment of FIG. 2 is seen in the hydraulic drive where an individual differential cylinder 126 is provided in the manner shown in FIG. 1. The velocity of movement of the piston 128 with the piston rod 130 is here different in the two directions and is dependent upon the surface ratio.

Also with this arrangement, different velocities can be predetermined by selecting different throttle cross sections on the inflow and outflow ends as well as through a selection of the surface ratio of the piston 128. For example, the throttle cross sections at the outflow end can be configured to be larger in relationship to the effective piston surfaces in order to obtain the same piston velocity in both directions.

It is understood that the foregoing description is that of the preferred embodiments of the invention and that various changes and modifications may be made thereto without departing from the spirit and scope of the invention as defined in the appended claims.

What is claimed is:

1. A control arrangement for a hydraulic drive for driving a piston pump for liquids, the hydraulic drive including a hydraulic cylinder and a hydraulic piston connected to the piston pump being driven, the hydraulic cylinder and hydraulic piston conjointly defining a cylinder chamber and a piston-rod chamber, the control arrangement comprising:

reservoir means for holding hydraulic fluid;

hydraulic fluid supply means for supplying hydraulic fluid under pressure from said reservoir means;

a first hydraulic power line for conducting hydraulic fluid to one of said chambers of said hydraulic drive from said hydraulic fluid supply means;

a second hydraulic power line for conducting hydraulic fluid away from the other one of said chambers of said hydraulic drive to said reservoir means;

a control unit including: a housing; and, a control piston movably mounted in said housing between a first end position and a second end position, said control piston including reciprocably acting first and second flow restrictors which restrict the flow of hydraulic fluid through said control piston in dependence upon the location of said control piston between said end positions;

said control unit being connected into said hydraulic power lines so as to cause the direction of flow through said first flow restrictor to always be away from said hydraulic fluid supply means and the direction of flow through said second flow restrictor to always be away from said hydraulic drive irrespective of the location of said piston between said end positions;

said control unit further including: first valve inlet means communicating with said first flow restrictor for passing hydraulic fluid from said hydraulic fluid supply means to the other one of said chambers of said hydraulic drive when said control piston is in one of said end positions; and, second valve inlet means communicating with said second flow restrictor for passing hydraulic fluid away from said other one of said chambers of said hydraulic drive to said reservoir means when said control piston is in the other one of said end positions;

an ancillary hydraulic power line for connecting said first valve inlet means to the other one of said chambers of said hydraulic drive;

first and second pressure balancers corresponding to respective ones of said first and second flow restrictors;

said first pressure balancer having a hydraulic power circuit connected into said ancillary hydraulic power line and being operatively connected to said first flow restrictor so as to be actuable in response to a change in pressure across said first flow restrictor;

said second pressure balancer having a hydraulic power circuit connected into said second hydraulic power line and being operatively connected to said second flow restrictor so as to be actuable in response to a change in pressure across said second flow restrictor; and, said control unit further including reversing valve means for actuating said control piston to displace the same from one of said end positions thereof to the other one of said end positions thereof in dependence upon the position of said hydraulic piston in said hydraulic cylinder.

2. The control arrangement of claim 1, said first pressure balancer being connected into said ancillary hydraulic power line downstream of said first flow restrictor; and, said second pressure balancer being connected into said second hydraulic power line downstream of said second flow restrictor.

3. The control arrangement of claim 1, said control piston defining a longitudinal axis and including: two pairs of first and second flow restrictors arranged on said axis in spaced relationship to each other; a first connection common to and communicating with the flow restrictors of said first pair for supplying hydraulic fluid to the hydraulic drive; and, a second connection common to and communicating with the flow restrictors of said second pair for passing hydraulic fluid away from the hydraulic drive.

4. The control arrangement of claim 3, said first valve inlet means including two first valve inlets corresponding to respective ones of said first and second flow restrictors of said first pair of flow restrictors; a first pair of pressure balancers connected downstream of corresponding ones of first valve inlets; said second valve inlet means including two second valve inlets corresponding to respective ones of said first and second flow restrictors of said second pair of flow restrictors; and, a second pair of pressure balancers connected upstream of corresponding ones of said second valve inlets.

5. The control arrangement of claim 1, said first flow restrictor and said first valve inlet means being configured so as to cause said first flow restrictor to pass hydraulic fluid when said control piston is midway between said end positions; and, said second flow restrictor and said second inlet valve means being configured so as to also cause said second flow restrictor to pass hydraulic fluid when said control piston is midway between said end positions.

6. The control arrangement of claim 1, said hydraulic fluid supply means including a hydraulic pump for pumping the hydraulic fluid at a constant volumetric rate; the combination of each of said flow restrictors and the pressure balancer corresponding thereto having a predetermined maximum through-flow volumetric rate greater than the largest through-flow volumetric rate determined by the capacity of said hydraulic pump.

7. The control arrangement of claim 1, said control piston defining a longitudinal axis and having a piston wall surrounding respective cavities formed in said piston; and, said first and second flow restrictors being respective slots formed in said wall so as to extend in the direction of said axis and so as to communicate with respective ones of said cavities.

8. The control arrangement of claim 1, comprising: control means for actuating said control piston in dependence upon the position of said hydraulic piston.

9. The control arrangement of claim 8, said control means comprising an auxiliary pump for supplying hydraulic fluid under pressure for displacing said control piston between said end positions.

10. The control arrangement of claim 8, said control means comprising means for controlling the switching speed of said control piston.

11. The control arrangement of claim 1, comprising: control means for actuating said control piston in dependence upon the position of said hydraulic piston, said control means including:

sensor means for detecting the respective positions of said hydraulic piston as it nears the respective ends of its stroke in said hydraulic cylinder; and, said reversing valve means being an electromagnetic valve and being operatively connected to said sensor means for actuating said control piston to move the same between said end positions thereof when said hydraulic piston nears said respective ends of said stroke.

* * * * *